US005975460A

United States Patent [19]

Elkanick et al.

[11] Patent Number: 5,975,460

[45] Date of Patent: Nov. 2, 1999

[54] NONLINEAR GUIDANCE GAIN FACTOR FOR GUIDED MISSILES

[75] Inventors: Mark E. Elkanick; James A. Bacon, both of Tucson, Ariz.

[73] Assignee: Raytheon Company, Lexington, Mass.

[21] Appl. No.: 08/967,158

[22] Filed: Nov. 10, 1997

[51] Int. Cl.[6] ..... F41G 7/00

[52] U.S. Cl. ..... 244/3.15

[58] Field of Search ..... 244/3.11, 3.15, 244/3.16

[56] References Cited

U.S. PATENT DOCUMENTS

| | | | |
|---|---|---|---|
| 3,984,068 | 10/1976 | McPhee | 244/3.19 |
| 4,189,116 | 2/1980 | Ehrich et al. | 244/3.16 |
| 4,396,878 | 8/1983 | Cole et al. | 318/648 |
| 4,502,650 | 3/1985 | Yueh | 244/3.15 |
| 4,529,151 | 7/1985 | Skarman | 244/3.13 |
| 4,721,270 | 1/1988 | Salkeld | 244/3.11 |
| 5,062,583 | 11/1991 | Lipps et al. | 244/3.15 |
| 5,279,478 | 1/1994 | Baida et al. | 244/3.15 |
| 5,429,322 | 7/1995 | Waymeyer | 244/3.15 |
| 5,435,503 | 7/1995 | Johnson, Jr. et al. | 244/3.15 |
| 5,605,307 | 2/1997 | Batchman et al. | 244/3.11 |
| 5,647,560 | 7/1997 | Schnatz et al. | 244/3.15 |
| 5,660,355 | 8/1997 | Waymeyer | 244/3.15 |
| 5,722,614 | 3/1998 | Wicke | 244/3.15 |

OTHER PUBLICATIONS

Paul Zarchan, Tactical and Strategic Missile Guidance, AIAA, pp. 25–26, 1994.

*Primary Examiner*—Charles T. Jordan
*Assistant Examiner*—Theresa M. Wesson
*Attorney, Agent, or Firm*—David W. Collins; Andrew J. Rudd; Glenn H. Lenzen, Jr.

[57] ABSTRACT

A system (10') for generating a missile guidance gain factor adapted for use with guided missiles. The inventive system includes a guidance control system (52) for obtaining current guidance parameters(55, 57) including ideal navigation gain, closing rate, line of sight rate, missile maneuverability, and missile velocity parameters. Software (56) running on a guidance control processor (54) computes a current guidance gain factor reflective of the current maneuverability of the missile from the guidance parameters (55, 57). In the illustrative embodiment, the system 10' further includes a nonlinear notch circuit (56) that generates an acceleration command (59) from the guidance parameters (55, 57) that varies in response to varying missile maneuverability parameters (57). The guidance control system (10') includes a conventional guidance law computation circuit (54, 55) and electromagnetic sensing equipment (52). An autopilot circuit (58) included in the system (10') provides the missile maneuverability parameters (57). In a specific embodiment, the nonlinear notch circuit (56) is implemented via software running on a guidance processor (54) which performs the following computation for generating the acceleration command (59): $A_{new}=G_{nl}\times A$, where $A_{new}$ is the acceleration command (59), A is a pre-existing acceleration command (53), and $G_{nl}$ is the missile guidance gain factor of the present invention. The guidance gain factor is a function of the ratio of the measured line of sight rate with respect to the ideal line of sight rate maximum, and is tailored to existing missile characteristics and performance requirements.

19 Claims, 3 Drawing Sheets

NONLINEAR GUIDANCE GAIN FACTOR FOR GUIDED MISSILES

BACKGROUND OF THE INVENTION

1. Field of Invention

This invention relates to missiles. Specifically, the present invention relates to systems for controlling the acceleration of a missile during flight.

2. Description of the Related Art

Missile systems are used in a variety of applications ranging from explosives delivery to satellite launching. Such applications require high performance missiles with accurate aiming and steering capability.

A typical missile system includes a guidance control processor that controls missile maneuvers. The control processor is often designed to generate steering and acceleration signals in response to target information received via infrared seekers and other electromagnetic sensing devices. The control signals that affect the acceleration of a missile are termed 'acceleration commands'.

In a typical missile system, acceleration commands are computed from missile target closing rate, ideal navigation gain, and an estimate of the line of sight rate. The closing rate is often approximated by the velocity of the missile. The line of sight rate and the navigation gain are often computed from target range and range rate information obtained from existing missile sensors.

Many existing missile systems require an operator to select parameters relative to the geometry of engagement. For example a fighter pilot may have to aim for the nose or the tail of a targeted aircraft. The resulting selected parameters affect the navigation gain of the missile system. Parameters selected in this way may quickly become unreliable as the engagement geometry changes during missile flight. This is particularly problematic for short range air-to-air combat applications.

In such systems, navigation gain often varies widely, depending on the missile engagement geometry, and is prone to human error. This often results in inconsistent and erroneous navigation gains. An erroneous navigation gain will result in undesirable oscillations about the missile's trajectory. These oscillations result in wasted kinematic energy, reduced aiming capability, and reduced missile speed. This reduces missile lethality and increases the ability of an adversary to shoot down the missile.

To overcome some of these problems, nonlinear guidance systems were developed. Such systems attempt to introduce nonlinearities in the navigation gain to compensate for changes in missile engagement geometry and operating environment during missile flight. Such nonlinear navigation gains are typically a function of the estimated or measured line of sight. The nonlinearities are based on pre-selected line of sight values. These systems, however, are limited in their ability to select appropriate line of sight values. The nonlinearities are often determined experimentally. Nonlinearities picked in this way often suffer from inconsistencies as missile systems and engagement geometries are varied. Additional time and expense is required to determine the appropriate parameters for different types of missile systems and engagement geometries. In addition, these non-linear parameters are typically based on missile velocity and do not account for other factors such as missile maneuverability.

As missile systems technology advances, more data becomes available pertaining to the current status and maneuverability of missiles. Guidance control systems must take advantage of this data in new and innovative ways to keep pace with other missile sub-systems.

Hence a need exists in the art for a cost effective system for improving missile acceleration commands. There is a further need for an acceleration command generation system that dynamically takes into account missile capability in response to changes in missile operating environment. The system should allow high terminal maneuvers with small miss distances, should be adaptable to existing missile systems, and should reduce missile performance problems associated with the inconsistent selection of parameters used to compute the navigation gain.

SUMMARY OF THE INVENTION

The need in the art is addressed by the system for generating a missile guidance gain factor of the present invention. In the illustrative embodiment, the invention is adapted for use with guided missiles and includes a guidance control system for obtaining current guidance parameters including ideal navigation gain, closing rate, line of sight rate, missile maneuverability, and missile velocity parameters. Software running on a guidance control processor computes a current guidance gain factor reflective of the current maneuverability of the missile from the guidance parameters.

In the illustrative embodiment, the system further includes a nonlinear notch circuit that generates an acceleration command from the guidance parameters that varies in response to varying missile maneuverability parameters. The guidance control system includes a conventional guidance law computation circuit and electromagnetic sensing equipment. An autopilot circuit included in the guidance control system provides the missile maneuverability parameters.

In a specific embodiment the nonlinear notch circuit is implemented via software running on a guidance processor which performs the following computation for generating the acceleration command:

$$A_{new}=G_{nl}\times A$$

where $A_{new}$ is the acceleration command, A is a pre-existing acceleration command, and $G_{nl}$ is the missile guidance gain factor of the present invention. The guidance gain factor is a function of the ratio of the measured line of sight rate with respect to the ideal line of sight rate maximum, and is tailored to existing missile characteristics and performance requirements.

The efficient design of the present invention is facilitated by the fact software running on existing missile systems may be simply adjusted via alterations in a look up table to utilize the gain factor of the present invention to improve acceleration commands. By utilizing missile maneuverability parameters, the present invention accounts for changing missile capability to adjust missile acceleration commands accordingly. This allows missiles to achieve high terminal maneuvers with small miss distances and reduces missile performance problems associated with the inconsistent selection of parameters used to compute the navigation gain

DESCRIPTION OF THE INVENTION

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
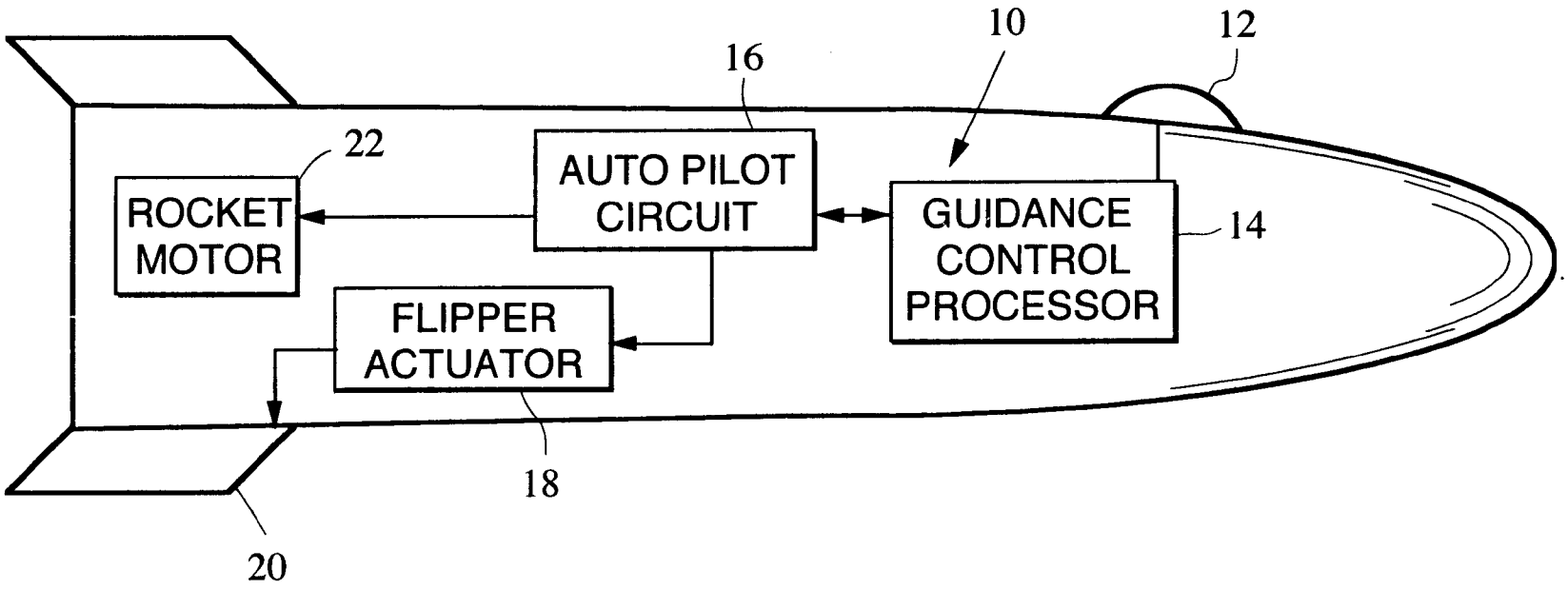
FIG. 1. ( PRIOR ART )
FIG. 1 is a diagram of a guided missile showing key functional components of a missile guidance control system, including the invention.

FIG. 1 is a diagram of a guided missile 5 showing key functional components of a missile guidance control system 10. The guidance control system 10 includes an electromagnetic energy sensor 12, a guidance control processor 14 including the nonlinear gain of the invention, and an autopilot circuit 16.

Missile tracking and targeting parameters such as range and range rate information are obtained via the missile sensor 12 and forwarded to the missile guidance control processor circuit 14. The processor 14 computes a guidance law from the received parameters which is forwarded to the autopilot circuit 16. The guidance law contains information relating to required missile steering and acceleration. The autopilot circuit 16 then triggers actuators that affect the various missile steering and acceleration devices. For example the missile 5 has a flipper actuator 18 that moves a flipper 20 in response to control signals generated by the autopilot circuit 16. A rocket motor 22 is selectively controlled by signals received via the autopilot circuit 16 to produce a desired missile acceleration.

Many modern missiles, unlike the missile 5, do not have access to continually measured and updated range and range rate information from sensors and other measuring devices. Such systems typically require action by the person aiming the missile system such as a pilot. The required action typically involves aiming the missile system, and setting initial parameters relating to range and range rate for the missile flight. Such systems are particularly prone to error and stand to benefit greatly from the present invention.

The guidance control processor 14 uses conventional proportional navigation to generate an acceleration command corresponding to the guidance law forwarded to the autopilot circuit 16. The acceleration command (A) is typically a function of ideal navigation gain ($G_{ideal}$), closing rate ($R_{closing}$), and estimated line of sight rate ($R_{los}$) parameters, where:

$$A=G_{ideal}\times R_{closing}\times R_{los}. \quad (1)$$

$R_{los}$ and $R_{closing}$ may be measured by an on board inertial measurement unit or approximated as a function of time based on missile design characteristics.

Figure 2:
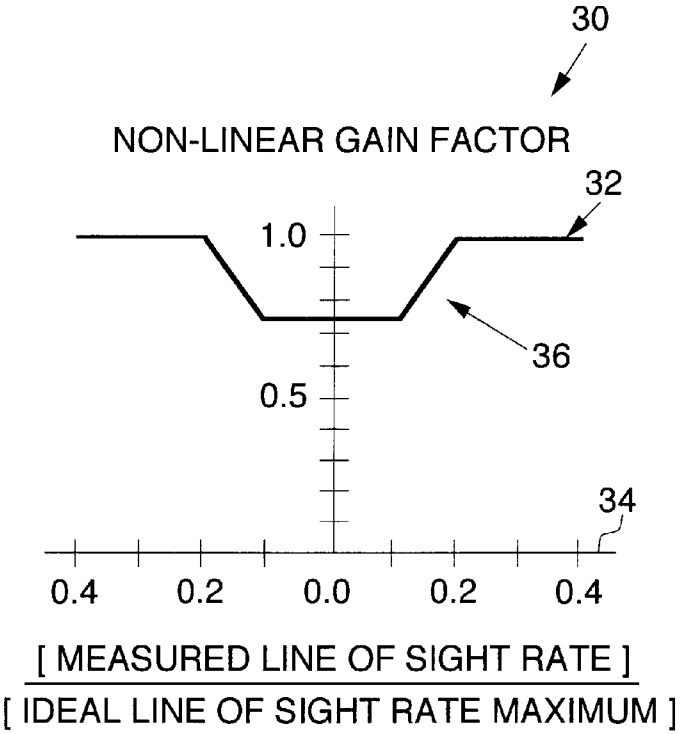
FIG. 2 is a graph of a first nonlinear gain factor developed in accordance with the teachings of the present invention.

FIG. 2 is a graph 30 of a first nonlinear gain factor 32 developed in accordance with the teachings of the present invention. The nonlinear gain factor ($G_{nl}$) 32 is a function of the ratio of a measured line of sight rate ($R_{los}$) to an ideal line of sight rate maximum ($R_{ideal\ max}$). The ratio is measured along the horizontal axis 34.

Estimated line of sight values are obtained via techniques pre-existing on the missile (see FIG. 1). The ideal line of sight rate maximum is computed in accordance with the following equation:

$$R_{ideal\ max}=(M_{max})/[(G_{ideal})\times(V)], \quad (2)$$

where $M_{max}$ is the maximum missile maneuverability, and V is the missile velocity. $M_{max}$ and V are parameters readily obtainable from existing missile guidance control processors (see FIG. 1). V is approximately equal to $R_{closing}$ of equation (1).

The nonlinear gain factor 32 is used to adjust the pre-existing acceleration command A. The new acceleration command ($A_{new}$) becomes:

$$A_{new}=G_{nl}\times A. \quad (3)$$

The gain factor 32 has a linear well 36. The effect of the linear well 36 is that when the missile is less maneuverable, the gain factor scales down the existing navigation gain which is proportional to the acceleration command. When the missile is more maneuverable, the gain is stepped up to account for the improved missile maneuverability, and an increased ability of the missile to handle increased acceleration. In the present specific embodiment, the magnitude of the missile maneuverability variable ($M_{max}$) is inversely proportional to the actual maneuverability of the missile. For example, a small $M_{max}$ corresponds to a large missile capability. This reduces undesirable missile oscillations that waste energy and decrease missile performance.

Those skilled in the art will appreciate that the maximum maneuverability $M_{max}$ may be replaced with another variable that contains missile capability or maneuverability information without departing from the scope of the present invention. In addition, the conventional acceleration command A in equation (3) may be replaced by another acceleration command without departing from the scope of the present invention.

Figure 3:
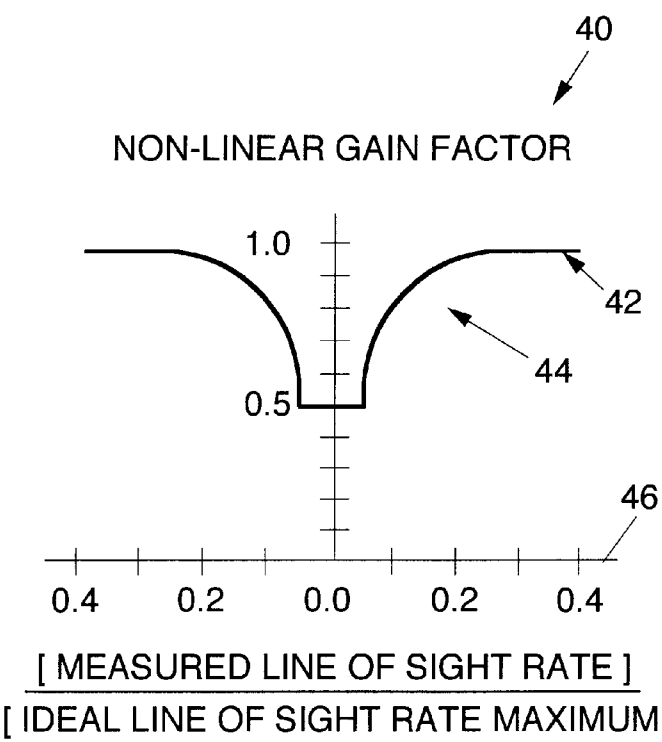
FIG. 3 is a graph of a second nonlinear gain factor developed in accordance with the teachings of the present invention.

FIG. 3 is a graph 40 of a second nonlinear gain factor 42 developed in accordance with the teachings of the present invention. The nonlinear gain factor 42 has an exponential notch 44. Different notch shapes are implemented to optimize missile system performance for a given missile system or application. Such shapes are chosen with regard to missile characteristics and performance requirements.

Nonlinear gain factors developed in accordance with the teachings of the present invention are preferably implemented via software running on a missile systems guidance control processor. The software implementation may include a look-up table containing an array of values pertaining to the gain factor. For example, the look up table may be indexed by selected values corresponding to points on a horizontal axis 46. The appropriate gain factors corresponding to the selected values may be then referenced via each index corresponding to each selected value. Such values may be continually updated in response to new information received via missile sensors, tracking devices, input devices, and so on.

Figure 4:
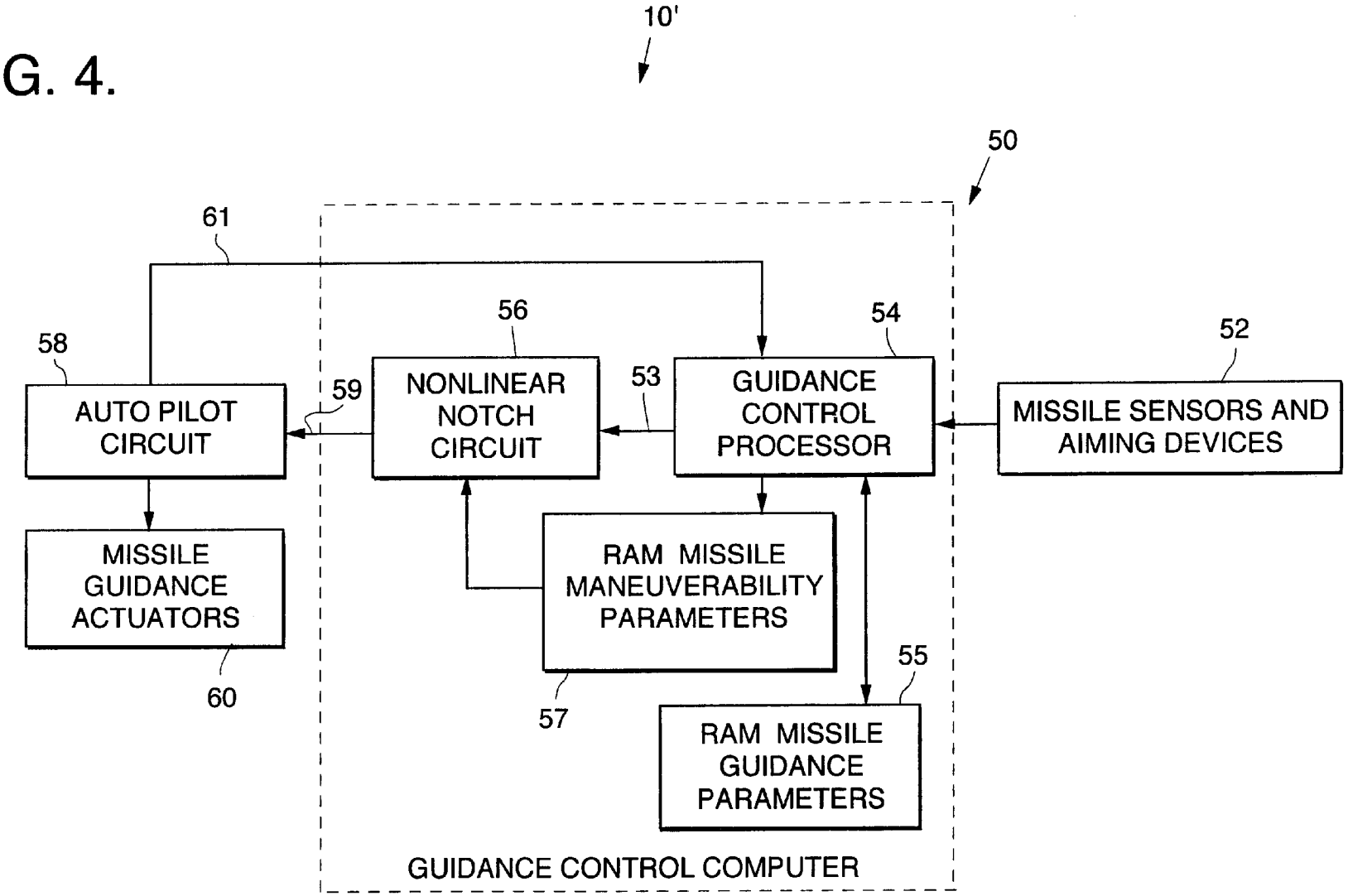
FIG. 4 is a block diagram showing key functional blocks of a guidance control system constructed in accordance with the teachings of the present invention.

FIG. 4 is a block diagram showing key functional blocks of a guidance control system 10' constructed in accordance with the teachings of the present invention. The control system 10' includes missile sensors and aiming devices 52 that provide guidance parameters to a guidance control processor 54 in a guidance control computer 50. The guidance control computer 50 further includes a first random access memory (RAM) 55, a second RAM 57, and a nonlinear notch circuit 56.

The guidance control processor 54 computes a guidance law 53 that specifies a preliminary acceleration command in accordance with equation (1). Missile guidance parameters required for computation of the guidance law 53 originate from the missile sensors and aiming devices 52 and/or signals (not shown) generated from pilot action. These parameters are stored in the first random access memory (RAM) 55 to facilitate the calculation of the guidance law 53 by the processor 54. The second RAM 57 stores missile maneuverability parameters required by a nonlinear notch circuit 56. The missile maneuverability parameters are obtained from the autopilot circuit 58 via a bus 61.

The nonlinear notch circuit 56 multiplies the guidance law 53 by the nonlinear gain factor as illustrated in FIG. 2 or FIG. 3. The notch circuit 56 outputs an improved acceleration command 59 that in accounts for the current missile operating environment in accordance with equation (3). Those skilled in the art will appreciate that the nonlinear notch circuit 56 may be implemented as a simple multiplier circuit with look-up tables, or in software having memory for storing look-up table values and means for multiplying the stored values in accordance with guidance gain factor.

The improved acceleration command 59 is forwarded to an autopilot circuit 58, which in turn, issues commands to missile guidance actuators 60 to control missile acceleration. The actuators 60 may actuate devices such as rocket motors and flippers.

The missile sensors and aiming devices 52, guidance control processor 54, autopilot circuit 58 and the missile guidance actuators 60 may all be implemented as conventional components obtainable from Hughes Aircraft Company. The nonlinear notch circuit 56 may be implemented in software running on the processor 56 via a look up table, or in hardware using conventional modules such as look up circuits, erasable programmable logic arrays, and multipliers.

A method for obtaining a nonlinear guidance gain factor in accordance with the teachings of the present invention includes the following steps:

1. Measuring a line of sight rate;

2. Computing an ideal line of sight rate maximum from pre-existing missile maneuverability, ideal navigation gain, and missile velocity parameters; and 3. Calculating the nonlinear guidance gain factor as a function of the measured line of sight rate and the ideal line of sight rate maximum.

4. Applying the nonlinear gain factor to pre-calculated missile guidance commands.

Step 3 may includes generating a ratio of the line of sight rate with respect to the ideal line of sight rate maximum calculating the gain factor so that a graph of the gain factor with respect to the ratio produces a dip or a well adjacent to the ratio=zero line.

Thus the present invention has been described herein with reference to a particular embodiment for a particular application. Those having ordinary skill in the art and access to the present teachings will recognize additional modifications applications and embodiments within the scope thereof.

It is therefore intended by the appended claims to cover any and all such applications, modifications and embodiments within the scope of the present invention.

Accordingly,

What is claimed is:

1. A system for generating a missile guidance gain factor for a missile in flight comprising:

first means for obtaining or estimating missile guidance parameters including maneuverability and current guidance parameters including ideal navigation gain, closing rate, and line of sight rate;

second means for computing an in-fight guidance gain factor reflective of the maneuverability of said missile from said guidance parameters; and third means for generating an acceleration command from said guidance parameters, said third means including computer software running on a guidance processor for performing the following computation for generating said acceleration command:

$$A_{new}=G_{nl}\times A$$

where $A_{new}$ is said acceleration command, A is a pre-existing acceleration command, and $G_{nl}$ is said missile guidance gain factor, said guidance gain factor being a function of the ratio of said measured line of sight rate with respect to an ideal line of sight rate maximum, said function tailored to existing missile characteristics and performance requirements.

2. The system of claim 1 wherein said first means includes fourth means for obtaining or estimating said closing rate parameters via missile velocity measurements.

3. The system of claim 2 wherein said fourth means includes electromagnetic sensing equipment.

4. The system of claim 1 wherein said third means includes a guidance law computation circuit.

5. The system of claim 1 wherein said first means includes electromagnetic sensing equipment.

6. The invention of claim 1 wherein said first means includes an autopilot circuit on said missile that provides said missile maneuverability parameters.

7. A missile guidance control system comprising:

first means for generating a first guidance command signal;

second means for altering said guidance command to account for missile maneuverability with respect to the current missile operating environment and providing a second guidance command signal in response thereto, said second means including a computer for executing the following equation to generate said second guidance command signal:

$$A_{new}=G_{nl}\times A$$

where $A_{new}$ is an acceleration command, A is a pre-existing acceleration command, and $G_{nl}$ is said missile guidance gain factor and is a function of missile maneuverability and a function of the ratio of said measured line of sight rate with respect to an ideal line of sight rate maximum, said function being tailored to existing missile characteristics and performance requirements; and third means for generating missile flight control signals in response to said second guidance command signal.

8. The control system of claim 7 wherein said third means includes an autopilot circuit.

9. The control system of claim 8 wherein said missile flight control signals include missile acceleration commands.

10. The control system of claim 7 wherein said first means includes a guidance law computation circuit.

11. The control system of claim 10 wherein said guidance law computation circuit is a computer that runs software to compute said first guidance command signal.

12. The control system of claim 11 wherein said guidance law computation circuit computes said first guidance command signal in accordance with a proportional navigation guidance law.

13. A method for obtaining a nonlinear guidance gain factor for a missile comprising the steps of:

computing first missile guidance commands;

measuring a line of sight rate for said missile;

computing an ideal line of sight rate maximum from pre-existing missile maneuverability, ideal navigation gain, and missile velocity parameters;

calculating said nonlinear guidance gain factor as a function of said measured line of sight rate and said ideal line of sight rate maximum; and applying said non-linear guidance gain factor to said first method missile guidance commands to generate new guidance commands.

14. The method of claim 13 wherein said step of calculating includes generating a ratio of said line of sight rate with respect to said ideal line of sight rate maximum.

15. The method of claim 14 wherein said step of calculating further includes calculating said gain factor so that a graph of said gain factor with respect to said ratio produces a well.

16. A system for obtaining a nonlinear guidance gain factor for a missile comprising:

first means for measuring a line of sight rate for said missile;

second means for computing an ideal line of sight rate maximum from pre-existing missile maneuverability, ideal navigation gain, and missile velocity parameters; and third means for calculating said nonlinear guidance gain factor as a function of said measured line of sight rate and said ideal line of sight rate maximum.

17. The invention of claim 16 wherein said means for calculating includes means for generating a ratio of said line of sight rate with respect to said ideal line of sight rate maximum.

18. The invention of claim 17 wherein said means for calculating further includes means for calculating said gain factor so that a graph of said gain factor with respect to said ratio produces a well.

19. A system for generating a missile guidance gain factor for a missile in flight comprising:

first means for obtaining or estimating missile guidance parameters including maneuverability and second means for computing an in-flight guidance gain factor reflective of the maneuverability of said missile from said guidance parameters, said guidance gain factor being a function of the ratio of a measured line of sight rate with respect to an ideal line of sight rate maximum and said function being tailored to existing missile characteristics and performance requirements.

* * * * *